United States Patent [19]

Shishoo

[11] 4,350,001

[45] Sep. 21, 1982

[54] METHOD FOR TREATING INSULATING FIBER

[75] Inventor: Roshan Shishoo, Askim, Sweden

[73] Assignee: Tex Innovation AB, Västra Frölunda, Sweden

[21] Appl. No.: 105,049

[22] Filed: Dec. 18, 1979

Related U.S. Application Data

[63] Continuation-in-part of Ser. No. 53,008, Jun. 28, 1979, abandoned, which is a continuation of Ser. No. 728,374, Sep. 3, 1976, abandoned.

[30] Foreign Application Priority Data

Nov. 18, 1975 [SE] Sweden ..... 7512944

[51] Int. Cl.[3] ..... B65B 55/00

[52] U.S. Cl. ..... 53/431; 28/265; 53/436; 53/440

[58] Field of Search ..... 53/431, 438, 440, 428, 53/430, 436; 28/265; 100/73, 74, 75, 38

[56] References Cited

U.S. PATENT DOCUMENTS

| | | | |
|---|---|---|---|
| 3,432,898 | 3/1969 | Stanley | 28/265 |
| 3,458,966 | 8/1969 | Dunbar et al. | 53/430 |
| 3,537,226 | 11/1970 | Levan et al. | 53/430 |
| 3,645,061 | 2/1972 | Mizutani | 53/440 |
| 3,745,915 | 7/1973 | Rehm | 100/38 |
| 3,946,600 | 3/1976 | Kuhtreiber | 100/74 |
| 4,053,678 | 10/1977 | Betz et al. | 28/265 X |

*Primary Examiner*—William R. Briggs

[57] ABSTRACT

A process for storing sound and heat insulating fiber materials comprising reducing fiber-fiber friction in the product by drying and by applying a friction reducing agent, preferably a silicone oil, onto said fibers, optionally freezing the product, preferably to a temperature below the glass transition temperature of the adhesive in the product, enclosing the product in an air-tight and moisture-proof material, evacuating the package and reducing the porosity of the product by at most ⅓ by compressing, sealing the package and, after storing, opening the package and optionally working the product mechanically.

13 Claims, 2 Drawing Figures

METHOD FOR TREATING INSULATING FIBER

Figure 1:
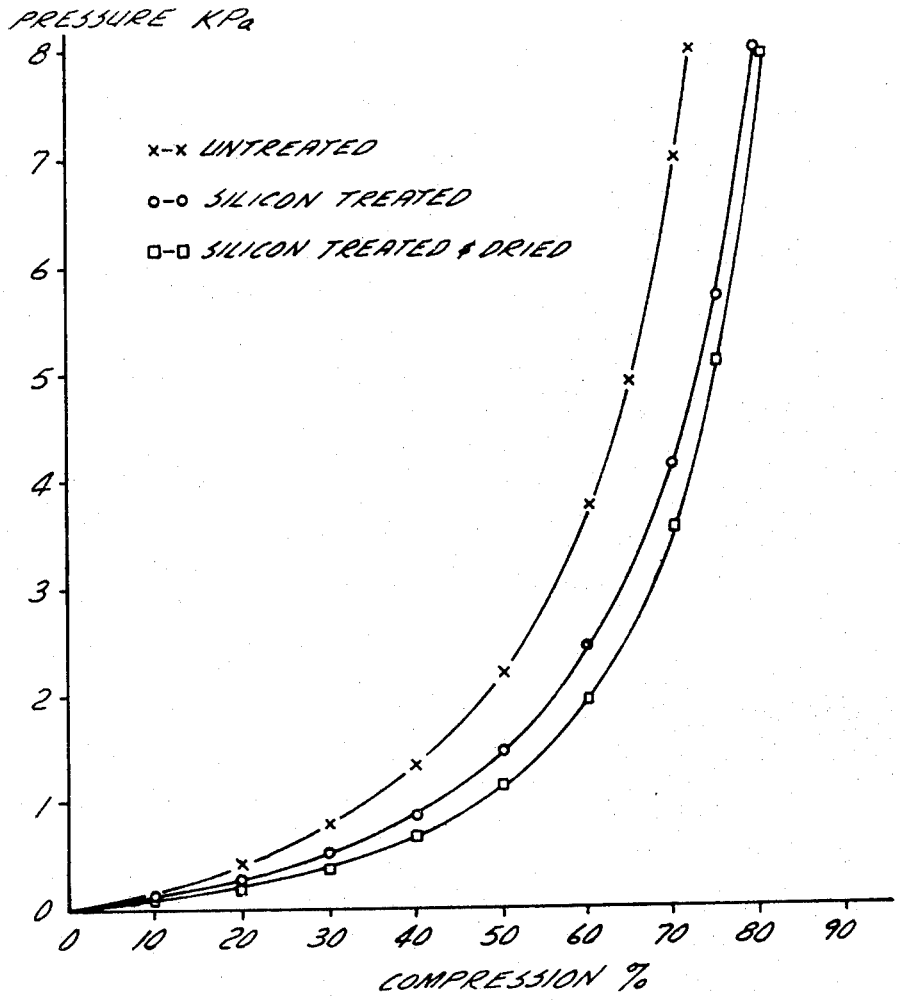

This application is a continuation-in-part of application Ser. No. 053,008 filed June 28, 1979, now abandoned, which is a continuation of abandoned Ser. No. 728,374 filed Sept. 3, 1976.

The present invention relates to a process for pretreating and packaging a sound or heat insulation product of inorganic fibers and an adhesive. According to the process of the present invention, the product is compressed and packed, and is stored in this form until it is to be used, at which time, the package is opened and the product returns to its original form and volume.

Sound and heat insulation products of inorganic fibers are very space-consuming. Storage and transport costs are therefore high. This makes, inter alia, long distance transport of such material expensive.

Packing the products in a compressed state to reduce their volume for transport and storage, and thereby reducing costs, has been tried. However, it has been shown that for conventional heat insulating sheets or blocks, with a bulk density of 10–20 $Kg/m^3$, a compression to less than 75% of the original volume is impossible, if complete recovery is desired after a long storage period. Even with this low volume reduction, there remains such an extensive deformation that heat insulation sheets must be manufactured with a thickness of 110 mm so as to have a thickness of 100 mm when used, after being stored for a longer period of time in the compressed state. Also, with the present packages, with for example 4 sheets in a package, or in a continuous sheet product in the form of a roll, problems arise due to slippage and shear forces between the sheets or the layers in the roll.

Heat insulation products of inorganic fibers contain an adhesive which on one hand, increases its rigidity so that the product more easily keeps its shape and, for example, can be compressed for a short period of time or be folded and thereafter returned to its original shape, and on the other hand, to reduce the formation of dust. The amount of adhesive used for these purposes is commonly about 5% of the weight of the product.

Experiments have been done employing an increased percentage of adhesive so as to obtain greater rigidity in an attempt to achieve recovery after a compression greater than 75% of the original volume for a longer period of time. This additional amount of adhesive, however, caused the product to recover more poorly and to retain its compressed shape.

It is therefore an object of the present invention to provide a method of treating and packaging a sound or heat insulation product wherein the product, following compression, returns to substantially its original thickness with minimum deformation and fiber breakage.

It is a further object of the present invention to provide a method of treating and packaging a sound or heat insulation product of an inorganic fibrous material permitting volume reduction during the compression of the product wherein, following a treatment of the material to reduce the friction between the fibers of the material to a level below the level of friction between the fibers prior to the treatment, such that when the compressed product is subsequently removed from the package, it recovers substantially its original volume.

It is still a further object of the present invention to provide a heat or sound insulation product of an open cell fiberglass material wherein the fibers of the fiberglass material have been treated with a friction reducing agent such that the material may be subsequently compressed and packaged and, following removal of the product from the package, it recovers substantially its original volume.

In one aspect of the present invention, there is provided an improved method which results in a product capable of recovering substantially its original volume. More particularly, in accordance with this aspect of the present invention, there is provided an improvement in a method of compressing or reducing the volume of a product to be packaged under compression and in which a sound or heat insulation product of fibrous material is packaged under substantially air and moisture impermeable conditions, in which the said improvement comprises reducing the friction between the fibers of the product below the level of the friction between the fibers of the product in an uncompressed state, prior to compressing the product to reduce the volume of said product whereby the recovery of a resulting compressed product to substantially its original volume is obtained after the product is freed from compression.

Thus, in accordance with this invention, it has been unexpectedly found that by reducing the friction between the fibers of the product, instead of, as was previously attempted, increasing the friction between the fibers of the product (by employing additional amounts of adhesive), the sound and heat insulation products of inorganic fibers which contain an adhesive can be compressed to a greater degree than was previously possible, while still permitting subsantially complete recovery after lengthy storage periods. Utilizing the method of the present invention, conventional heat insulation sheets or batts can be compressed to less than about 75% of their original volume, suitably between 10–30% of their original volume and preferably between about 15–20%.

In the preferred embodiment of the present invention, after carrying out the step of reducing the fiber-to-fiber friction in the product, the products may be chilled or cooled for a short period of time before compression, suitably to a temperature at or below the glass transition temperature of the adhesive in the product.

In a still further embodiment of the present invention, the method of the present invention may include the steps of compressing the product after the step of reducing the friction between the fibers of the product, and packaging the product in an air-impermeable and moisture-impermeable material whereupon the product is stored in this form until it is to be used. At the time of use, the packaging material may be ruptured and the product will return to substantially its original form and porosity. During the step of compressing the product for packaging, the porosity of the product may be reduced by up to $\frac{1}{3}$ of its original porosity and on packaging the product, the air enclosed in the package and the product may be removed. Subsequent to opening the product, the product may be subjected to an optional step of mechanically working the product as, for example, by vibration or shaking, to expedite the recovery of the product to substantially its original state.

With respect to the optional step of mechanically working the product, the recovery of the product, when it is unpackaged, may be accelerated. To this end, the product can be placed on a vibrating belt. This post-treatment is however, not necessary to achieve complete recovery; it merely effects a quicker recovery.

For a sound or heat insulation product in general, it is difficult to give directly the percent of volume reduction which can be achieved by compression since this is, to a great extent, dependent on the porosity of the product, i.e., its air content. A product of greater porosity and greater air content can of course be compressed more than a product of less porosity. The relationship between porosity and bulk density and bulk volume is given by the following:

$$\text{Porosity (\%)} = 100 \times \left(1 - \frac{\text{fiber glass volume}}{\text{bulk volume}}\right) = 100 \times \left(1 - \frac{\text{bulk density}}{\text{fiber glass density}}\right).$$

The density of the glass is 2500 Kg/m$^3$. The following values were obtained:

| Bulk density, Kg/m$^3$ | Porosity, % |
|---|---|
| 1 | 99.69 |
| 10 | 99.6 |
| 25 | 99 |
| 100 | 96 |
| 200 | 92 |
| 400 | 84 |
| 600 | 76 |
| 800 | 68 |
| 1000 | 60 |
| 2000 | 20 |
| 2500 | 0 |

A conventional heat insulation product with a bulk density of about 15 Kg/m$^3$ can now be compressed to 75% of its original volume and can be further compressed by the present process, to for example 10% (bulk density 150 Kg/m$^3$), and even to 3% or 2% of its original volume. This corresponds to an increase in the bulk density of up to about 800 Kg/m$^3$ and a reduction in the porosity of down to about 70%, i.e., by approximately $\frac{1}{3}$. Even more porous material, e.g., with a bulk density of 1–5 Kg/m$^3$, as well as more compact sound insulation material with a bulk density of about 200 Kg/m$^3$, can be compressed to the same porosity, e.g., the porosity can be reduced by about $\frac{1}{3}$.

In accordance with a further embodiment of the present invention, the method may be characterized as including the step of reducing the friction between the fibers in the product, an optional quick freezing of the product, suitably to a temperature below the glass transition temperature of the adhesive in the product, enclosure in a package of an air-tight material with low water vapor permeability, compression to reduce the porosity by at least $\frac{1}{3}$, suitably around $\frac{1}{4}$, and evacuation of the air in the package, followed by sealing of the package in an air and moisture-tight manner. When the package is opened it can be worked mechanically to achieve a quicker recovery.

In carrying out the method of the present invention for reducing the friction between the fibers of the product, this may be achieved in many ways. In one embodiment, an agent which reduces the fiber-friction between the fibers of the product may be employed or added to the product. This agent or additive should be evenly distributed in and through-out the product for best results and can, for example, be introduced in a finely divided form, e.g. by spraying the fiber product. The agent can be introduced as is, or it may be dissolved in a solvent.

If a solvent is used in the application of the friction reducing agent, it can either be allowed to evaporate before the product is packaged, or the product can be packed in a material which is permeable to the solvent so that the solvent can evaporate during storage.

To enable the friction reducing agent to penetrate in between the fibers and be evenly distributed, the preparation which is applied should have a viscosity of below 100 cSt., suitably a maximum of 20 cSt., and preferably 5–10 cSt.

The agent is suitably applied in an amount of at most 5% by weight, suitably 0.2–2% by weight and preferably 0.3–0.8% by weight.

Various silicone oils can be used as friction reducing agents.

The fiber-fiber friction in the insulating material can also be reduced by reducing the amount of moisture on the fiber surfaces in the product, i.e., by drying the product. The drying can be done with the aid of a vacuum or dry air. It is also possible to combine the drying step with the actual production of the fiber products and as such, very dry air or a vacuum in the curing oven, used for curing the adhesive in the product, may be used. If the drying is done in a curing oven, the subsequent cooling of the product must be done slowly and in dry air so that no moisture precipitates onto the fiber surfaces.

Suitably, the product is dried to a moisture of below 1% by weight, preferably 0.3–0.6% by weight, based on the dry weight of the product.

The reason that the reduction of the moisture reduces the friction between the fibers is that a water layer on the fibers causes the fibers to be attracted to one another, thereby creating an adhesive effect. Thus, adsorbed moisture on inorganic fibers has quite different effects than moisture inside organic fibers, such as wool, where the water is absorbed. In changing the shape of textile fibers containing moisture, a structural change in the fiber itself can occur, while the compression of insulation material of inorganic fibers with water on the surfaces requires greater force and causes poorer recovery due to the adhesive effect of the water.

The two friction reducing methods can be combined, and thus, the insulation product may first be dried and then impregnated with a friction reducing agent. However, it is also possible to use only the friction reducing agent.

Reduction of the friction between the fibers of the product thus makes possible a compression of the material so that the fibers are displaced without being deformed or broken. There will be a minimal displacement, if any, between the fibers at those points in the material which are glued together with adhesive. Due to the fact that other displacements can occur and the tension redistributed, there will be no deformation of the fibers at these points. The glue points will however be under tension during the storage of the product in the compressed state, although the tension will be less than at the actual moment of compression due to the displacements which have occurred. This remaining tension causes the product, when unpacked, to return to its original shape and volume.

A certain slippage between the fibers at the glue points can, however, occur with the thermoplastic resins when the temperature is above the glass transition temperature of the adhesive. Therefore, it is appropriate to further improve the adhesion between the fibers at these points during compression, by cooling the product, before this step, down to a temperature below the glass transition temperature of the adhesive.

It is important that no water precipitate onto the fiber surfaces during storage, causing increased sticking and thus poorer recovery to its original shape. Therefore, the products should be enclosed in a package consisting of a material with low water vapor permeability. The package should also keep the product together in its compressed state. This can be done by drawing the air out of the package and sealing it in an air and moisture-tight manner. The packaging material should be air-tight.

Polyethylene, for example, preferably high density polyethylene, can be used as a packaging material. It is especially suitable to use a composite material with a core of high density polyethylene and a layer of low density polyethylene on either side. This combines the low water vapor permeability of the high density polyethylene and the good weldability of the low density polyethylene.

The products can be stored for a long period of time in the compressed state, e.g., for the usual storage time for heat insulation sheets of 6–8 months. When unpacked, they quickly return to their original shape and porosity. The speed of recovery can be increased by mechanical treatment, e.g., by shaking or vibrating of the products.

Figure 2:
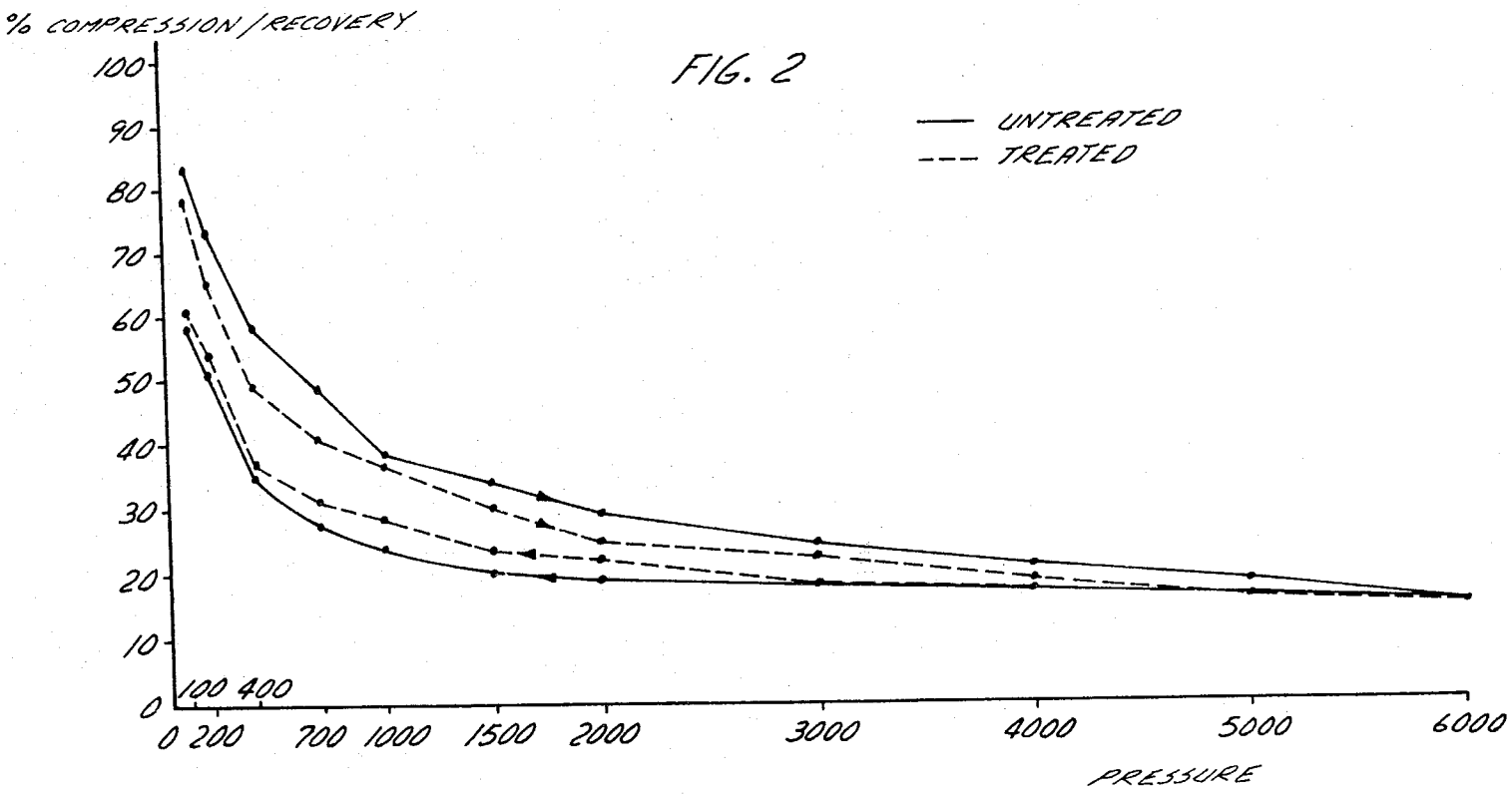

Reference will now be had to the specific examples and illustrations and embodiments of the invention; in the drawings, FIG. 1 is a graph illustrating the pessures required to achieve various compression percentages on differently treated materials, while FIG. 2 is a graph illustrating the recovery characteristics of treated versus untreated materials.

The following trials demonstrate the effect of the various steps in the present process.

Conventionally compressed and recovered glass wool sheets, Gullfiber type 3004 with a weight of 330 g and the dimensions 570×360×105 mm, were used. After the treatments listed below, the sheets were compressed to a thickness of 15 mm, were packed in packages of low density polyethylene (polyethylene LD), and the packages were welded shut after evacuation of air. The packages were stored for 14 days at 20° C., and were then opened, and the preformance of the sheets was observed. The thickness was measured after about 5 seconds, i.e., after the first rapid increase in volume, after 2 minutes, whereafter the sheets were carefully shaken and their thicknesses were again measured after 3 minutes. A final measurement was made after 4 days.

The following treatments were given to the sheets before compression:

(1) No treatment, packed at room temperature, about 24° C.;

(2) Water vapor treated for about 30 seconds, took up approximately 35 g of water; packaged directly after treatment;

(3) Refrigeration treatment without drying for about 5 hours to a temperature of −22° C.; packed directly from the freezer;

(4) Spray treated with 50 $cm^3$ 10% by volume (1.4% by weight) silicone fluid having silicone solids content: 100% dissolved in white spirit; then refrigeration treated according to (3); or (5) Spray treated according to (4) and packed directly.

TABLE I

| Treatment | THICKNESS AFTER 5 sec. | 2 min. | 3 min. | 4 days |
|---|---|---|---|---|
| 1* | 95 | 95 | 95 | 103 |
| 2 | 85 | 85 | 84 | 97 |
| 3 | 87 | 90 | 93 | 99 |
| 4 | 90 | 92 | 96 | 102 |
| 5 | 95 | 96 | 101 | 105 |

As can be seen from Table I, the thickness of the material stopped increasing after the first rapid increase, for at least 3 minutes, for the untreated sheet (1). In contrast, the silicone treated sheet (5) increased in size over the whole 3 minute period. An appreciable difference could thus be observed for the recovery ability of the sheets after so short a storage time as 14 days.

The treatment (2) with vapor was designed to show how the presence of water on the fibers affects the recovery. As can be seen from the table, the thickness of the sheet immediately after unpacking was appreciably below the thickness of the relatively dry sheets (1) and (5). Furthermore the thickness remained the same for at least 3 minutes.

Sheet (3), which was treated by freezing, also acquired a layer of moisture on the fibers due to condensation, since the sheet was not dried before freezing. In comparison with sheet (2), the sheet had a better recovery due to the freezing step, as is evident from the increase in thickness during the first 3 minutes. Sheet (4), which was treated with the friction reducing agent before freezing, had a better result than sheet (3).

Sheet (5) was dry in comparison to sheet (4) (since sheet (5) was not freeze-treated and thus, no additional amount of moisture was precipitated onto the fibers) and thus in comparison to sheet (4), represents a sheet which has both been dried and treated with a friction reducing agent. It is evident from the results that an especially improved result can be achieved by a combined treatment with both drying and the application of a friction reducing agent.

As may be seen from the above, advantageous results can be achieved from all treatments. The test or control sample treatment number 1 was repackaged 3 times during the 14 day test period and it is believed that the rupturing of the package and repackaging allowed a greater recovery to be achieved in the test results than would otherwise be the case.

After 4 days all of the sheets returned nearly to their original thickness, the moist sheets (3) and (4) having a somewhat lower thickness than the other three sheets. This good recovery after 4 days was not surprising in view of the short storage time in the compressed state. However, it is clearly evident from the differing speeds of volume increase during the first 3 minutes that even after so short a storage time as 14 days, appreciable differences occur in recovery capability depending on whether the sheets were treated with friction reducing agent or not, whether or not they are moist, and whether or not they have been refrigeration treated.

Glass wool sheets (Gullfiber AB) were subjected to compression tests under various pressures, using both sheets in the treated and untreated states. The results of the tests are shown in FIG. 1 wherein it will be noted that the untreated sheets require a greater pressure to achieve the same compression as treated sheets. Still further, the untreated sheets could not be compressed to the same extent as the treated sheets. Thus, apart from the better reconditioning effects achieved, the compression stage itself can be made under a lower pressure with consequently less energy being employed.

Glass wool sheets (Gullfiber AB) having a thickness of approximately 100 mm with a density of 17 kg/m$^3$ were spray treated with a silicone fluid having silicone solids content: 100% dissolved in a white spirit so as to give a silicone deposition of 1 percent by weight. Spraying was done uniformly across the thickness of the batts. The batts were then compressed under a gradually increasing load up to 6 kg and subsequently these were gradually unloaded. FIG. 2 shows the results of this test from where it can be seen that the treated batts show less hysteresis effect in the loading/unloading procedure than the untreated batts. This illustrates that the treated sheets or batts provide an improved recovery performance after a silicone treatment.

Subsequently, both untreated and silicone treated glass wool sheets as set forth above were compressed on an Instron tester at a compression ratio of 5:1. Thereafter, the stress or pressure relaxation was measured after 2 and 16 hours constant compression. The results are given in Table II below. As will be noted, the stress loss is lower for silicone treated sheets than for the untreated sheets. This indicates that the reconditioning in a silicone treated material should be better than an untreated material due to the lower stress losses.

TABLE II

| | $\sigma 2/\sigma 0$ | $\sigma 16/\sigma/0$ |
|---|---|---|
| Untreated | 64 | 59 |
| Treated | 68 | 64 |

$\sigma 0$ — stress at compression ratio of 5:1 after 0 hours
$\sigma 0$ — stress at compression ratio of 5:1 after 2 hours
$\sigma 0$ — stress at compression ratio of 5:1 after 16 hours Further tests were run on both treated and untreated glass wool sheets as shown in Table III. The different reconditioning values achieved are shown in Table III.

TABLE III

Product:
Glass wool sheets (Gullfiber AB)
Approximately 105mm thickness[1]
Compression ratio 5:1
Compression time 18 days
Sample size 50 × 60cm

| | % Silicon[2] | Thickness in mm after various reconditioning times periods: Pressure 100 Pa TIME 0 | 4h | 20h | 45h | 95h | Pressure 60 Pa TIME 95h | Pressure 30 Pa TIME 95h |
|---|---|---|---|---|---|---|---|---|
| #3009 | 0.0 | 88 | 93 | 94 | 95 | 97 | 102 | 103 |
| density | 0.5 | 89 | 94 | 95 | 97 | 98 | 103 | 106 |
| 17 Kg/m$^3$ | 1.0 | 89 | 94 | 95 | 97 | 98 | 103 | 106 |
| #3029 | 0.0 | 83 | 88 | 90 | 94 | 94 | 99 | 103 |
| density | 0.5 | 89 | 92 | 94 | 96 | 97 | 103 | 107 |
| 22 Kg/m$^3$ | 1.0 | 96 | 100 | 102 | 104 | 105 | 109 | 111 |

[1]subject to variation
[2]on weight basis

As will be seen from Table III, the treated material was in all instances superior to the untreated material not having the friction reducing agent in the form of the silicone particularly, with those sheets having the higher density.

Further trials were run employing mineral wool plates (Rockwool) of approximately 90 mm thickness which were compressed at a ratio of 4 to 1, packaged in a substantially air-tight package after evacuation of air, and stored for 14 days following which they were opened and the thickness measured immediately after unpacking, after 24 hours and after 48 hours. The results are given in a Table IV wherein the following treatments were given to the sheets before compression:

(A) no treatment;
(B) dried for 2 hours at 70° C. and packaged directly;
(C) treated with silicone (oil-in-water emulsion of 200 cSt silicone fluid), silicone solids content: 35%;
(D) treated with silicone (oil-in-water emulsion of 200 cSt silicone fluid), silicone solids content: 35% and dried for 2 hours at approximately 70° C.

TABLE IV

| Treatment | Thickness after (in mm) 0 hours | 24 hours | 48 hours |
|---|---|---|---|
| A | 60 | 65 | 75 |
| B | 75 | 78 | 80 |
| C | 75 | 90 | 90 |
| D | 80 | 87 | 90 |

Again, it will be seen that the silicon treated material shows substantially better results than the untreated material while even the material which has been dried but not treated with silicone shows improved results over the untreated material.

The present invention is not only very advantageous due to the reduced storage and transportation costs involved, but for other reasons as well. By completely enclosing the products in tight packages, there is no spreading of dust or fibers. This is of importance for the working environment. The compressed sheets, enclosed in their packages, can easily be put in place, for example in a wall. The sheets, the thickness of which has been reduced for example to 15–20% of the original thickness, can be easily inserted in the wall and are completely flat, in contrast to the sheets now used, which often are of uneven thickness due to the fact that the packaging material only encloses a portion of the sheets. Thus, they can be easily stacked, creating a continuous insulating mass, which completely fills out the wall with respect to width, height and depth when the packages are cut open and the sheets expand. This, on the one hand, facilitates the work and on the other hand, gives better protection to those working with the sheets, because they will not get fibers on themselves or breathe in fiber dust, since all work is done with the sheets hermetically sealed and the packages are opened by cutting them open after they have been put in place.

The present invention can of course be used for sound as well as heat insulation material. The process can be suitably used for the treatment of insulation material in the form of sheets, and their thickness is reduced so that the porosity is reduced. For a heat insulation product with a bulk density of 15–20 Kg/m$^3$, the thickness is suitably reduced to about 15–20% of the original thickness. However, other forms of insulation material can be treated, such as long webs or strips stored as rolls. The continuous sheet fiber would then pass through rollers for compression and then be rolled up. By balancing the forces between the fibers, by the present process, there occurs fewer problems with slippage and shear forces between the various layers of the roll than occur with conventional compression and rolling. Also, as has been shown by the Examples, the amount of energy required to compress the product and/or the degree of compression attainable is improved employing the method of the present invention.

It will be understood that various modifications and changes may be made to the above-described embodiment without departing from the spirit and scope of the invention.

The embodiments of the invention in which an exclusive property or privilege is claimed are defined as follows:

1. A method of packaging an inorganic fibrous product suitable for use as thermal or sound insulation, comprising the steps of treating the fibers of said product with a friction reducing agent, reducing the moisture content of the product, chilling or cooling the product, compressing the product to reduce its volume to at least 30% of its original volume and subsequently wrapping said product in a moisture-impermeable package.

2. A method as defined in claim 1 wherein the friction-reducing agent is a silicone oil applied in an amount of up to 5% by weight of the product.

3. A method as defined in claim 1 wherein said product is compressed to between 15 to 20% of its original volume.

4. A method as defined in claim 1 wherein said cooling is carried out to a temperature below the glass transition temperature of the adhesive.

5. A method as defined in claim 1 which comprises the further step of working the product mechanically after the product is removed from the package to accelerate the recovery of the product.

6. A method of reducing fiber breakage in the packaging of inorganic fibrous thermo and sound insulating products, the method comprising the steps of treating said fibers with a friction-reducing agent, subsequently reducing the moisture content of the product, and thereafter compressing the same, to occupy a volume of less than 30 percent of its original volume.

7. A method as defined in claim 6 wherein the fibrous insulation product contains an adhesive.

8. A method is defined in claim 7 which comprises the step of cooling the product after treatment of the product to reduce the friction between the fibers of the fibrous insulation product and wherein said cooling is carried out to a temperature below the glass transition temperature of the adhesive.

9. A method as defined in claim 6 wherein the amount of moisture is reduced to below 1 percent by weight based on the dry weight of the product.

10. A method as defined in claim 6 wherein the friction-reducing agent is applied in an amount of up to 5 percent by weight of the product.

11. A method as defined in claim 10 wherein the friction-reducing agent is a silicone oil.

12. A method of treating and packaging a sound or heat insulation product of an inorganic fibrous material to reduce fiber breakage and permit its volume reduction during compression of the product, which comprises treating said product to reduce the friction between the fibers of the fibrous sound or heat insulation product to a level below the level of the friction between the fibers prior to said treatment, and subsequently compressing said fibrous insulation material to reduce the volume thereof and packaging the same under substantially air and moisture impermeable conditions, whereby when the compressed product is subsequently removed from the package, said fibrous product recovers substantially its original volume and including the further step of chilling or cooling the product after treating the product to reduce the friction between the fibers of the fibrous insulation product.

13. The method of treating and packaging a sound or heat insulation product of an inorganic fibrous material to reduce fiber breakage and permit its volume reduction during compression of the product, which comprises treating the product to reduce the friction between the fibers of the product to a level below the level of the friction between the fibers prior to said treatment, cooling the product, and subsequently compressing the material to reduce the volume thereof and packaging the same under substantially air and moisture impermeable conditions.

* * * * *